US009192865B2

(12) United States Patent
King et al.

(10) Patent No.: US 9,192,865 B2
(45) Date of Patent: Nov. 24, 2015

(54) SYSTEM AND METHOD FOR CONTROLLING A VEHICLE ON FIXED PATH

(75) Inventors: Steven Morris King, Orlando, FL (US); Justin Michael Schwartz, Orlando, FL (US); Steven C. Blum, Orlando, FL (US)

(73) Assignee: Universal Studios LLC, Universal City, CA (US)

( * ) Notice: Subject to any disclaimer, the term of this patent is extended or adjusted under 35 U.S.C. 154(b) by 1827 days.

(21) Appl. No.: 12/182,465

(22) Filed: Jul. 30, 2008

(65) Prior Publication Data

US 2010/0026484 A1 Feb. 4, 2010

(51) Int. Cl.
*G08B 13/14* (2006.01)
*A63G 7/00* (2006.01)

(52) U.S. Cl.
CPC ..... *A63G 7/00* (2013.01)

(58) Field of Classification Search
USPC ..... 340/572.1–572.9, 10.1–10.5
See application file for complete search history.

(56) References Cited

U.S. PATENT DOCUMENTS

| | | | | |
|---|---|---|---|---|
| 5,583,844 | A | 12/1996 | Wolf et al. | |
| 2002/0179703 | A1* | 12/2002 | Allen | 235/381 |
| 2003/0106455 | A1 | 6/2003 | Weston | |
| 2004/0017281 | A1* | 1/2004 | Dix | 340/5.61 |
| 2006/0157563 | A1* | 7/2006 | Marshall | 235/382 |
| 2007/0121957 | A1 | 5/2007 | Trowbridge et al. | |
| 2009/0108989 | A1* | 4/2009 | Sinclair | 340/5.62 |

FOREIGN PATENT DOCUMENTS

| | | | |
|---|---|---|---|
| EP | 0667798 | B1 | 2/1994 |
| JP | 07178252 | | 7/1995 |
| KR | 2007000568 | | 1/2007 |
| WO | 2006084330 | A1 | 8/2006 |
| WO | 2006107926 | A3 | 10/2006 |

OTHER PUBLICATIONS

Office Action for Japanese Patent Application No. 2011521151 issued Jun. 30, 2014.
Office Action for European Patent Application No. 09789985.0 mailed Nov. 26, 2014.
Notice of Preliminary Rejection for Korean Application No. 2011-7002288 mailed Aug. 5, 2015.

* cited by examiner

*Primary Examiner* — Ojiako Nwugo
(74) *Attorney, Agent, or Firm* — Fletcher Yoder, P.C.

(57) ABSTRACT

A system for confirming authorization of a operator for controlling a vehicle on fixed paths, the system having at least one ride vehicle with an onboard control system being configured to confirm operator authorization prior to allowing operator control thereof and an electronic device dimensioned and configured to be supported by an operator, the electronic device being further configured to remotely authorize operator control of the onboard control system. A method for confirming authorization of an operator for controlling a vehicle on fixed paths is also provided.

25 Claims, 4 Drawing Sheets

SYSTEM AND METHOD FOR CONTROLLING A VEHICLE ON FIXED PATH

BACKGROUND

The present invention relates to vehicles that reside on a fixed path. More specifically, the present invention relates to a control system and method for vehicles that reside on a fixed path.

Since the early twentieth century, controlling vehicles that reside on a fixed path such as trains, intrafactory cargo vehicles, and amusement park rides has lead to important industrial growth and consumer satisfaction. In the case of amusement parks, guests have demanded bigger, better, and more elaborate rides, they also require and expect a positive park experience, which entails progressively shorter waits to enter a ride. This requires Park management to balance two very important interests—guest satisfaction and safety.

Integrated control systems for a number of rides, from rollercoasters to log flumes, is known. In the past, human operators along the ride path would control breaking mechanisms to maintain vehicle spacing. More recently, path-mounted sensors have been used to control breaking and vehicle spacing. Other attractions use a plurality of platen drives, having a wheel or other path-mounted drive element that contacts a platen of each ride vehicle, to drive and control speed of the ride vehicles at all locations along the path. These control systems are generally limited to controlling ride vehicles at the operator control console, typically located at the boarding station. From the operator control console, the operators also have the ability to control not only breaking, but dispatch, reentry and tuning as well.

Recently, an onboard control system was disclosed by Baxter, et al., EP 0 667 798 B1. Baxter discloses an onboard control system that controls actions of the particular vehicle in the form of one of steering, velocity and articulation of a motion base relative to a passenger supporting structure, according to a programmably defined motion pattern defined by sequenced program instructions of a ride program, the motion pattern providing a defined spatial interaction with a dimensional set element.

The above types of control systems are insufficient because in many cases, two operators are required for dispatching a car. For example, in the case of rollercoasters, one operator must support the operator control console while another operator checks the safety feature of the car such as shoulder bars and seat belts. This, in effect, doubles the cost of labor for each ride.

Accordingly, to date, no suitable system or method for controlling vehicles on a fixed path is available.

BRIEF DESCRIPTION

The present disclosure describes a system and method for confirming authorization of an operator for controlling a vehicle on a fixed path.

In one embodiment, the invention describes a system for confirming authorization of a ride operator for controlling a vehicle on a fixed path, the system comprising at least one ride vehicle comprising an onboard control system being configured to confirm operator authorization prior to allowing operator control thereof and an electronic device dimensioned and configured to be supported by an operator, the electronic device being further configured to remotely authorize operator control of the onboard control system.

In another embodiment, the invention describes a method for confirming authorization of a ride operator for controlling an amusement park ride, the method comprising confirming operator authorization via an onboard vehicle control system wherein if an electronic device configured to communicate with vehicle system is proximate thereto, the operator is authorized to control the system.

Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Like reference characters designate identical or corresponding components and units throughout the several views, which are not to scale unless otherwise indicated.

DETAILED DESCRIPTION

One embodiment of the present invention involves a system for confirming authorization of a ride operator for controlling an amusement park ride and/or requesting a destination of a ride vehicle, the system comprising at least one ride vehicle having an onboard control system being configured to confirm operator authorization prior to allowing operator control thereof, and an electronic device dimensioned and configured to be supported by an operator, the electronic device being further configured to remotely authorize operator control of the onboard control system. One particular advantage afforded by this invention is the ability of an operator to interact directly with an onboard system thus obviating the need for more than one operator to grant authorization for operator control of a vehicle.

Specific configurations and arrangements of the claimed invention discussed below with reference to the accompanying drawings are for illustrative purposes only. Other configurations and arrangements that are within the purview of a skilled artisan can be made, used, or sold without departing from the spirit and scope of the appended claims.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Although specific features of various embodiments of the invention may be shown in some drawings and not in others, this is for convenience only. In accordance with the principles of the invention, the feature(s) of one drawing may be combined with any or all of the features in any of the other drawings. Moreover, any embodiments disclosed herein are not to be interpreted as the only possible embodiments.

Rather, modifications and other embodiments are intended to be included within the scope of the appended claims.

As used herein the term "proximate" is intended to comprise touching or in close range, e.g., within approximately 12 inches. As used herein, the term "fixed path" is intended to comprise any vehicle whose movements or destinations is controlled by external forces e.g., tracks.

Figure 1:
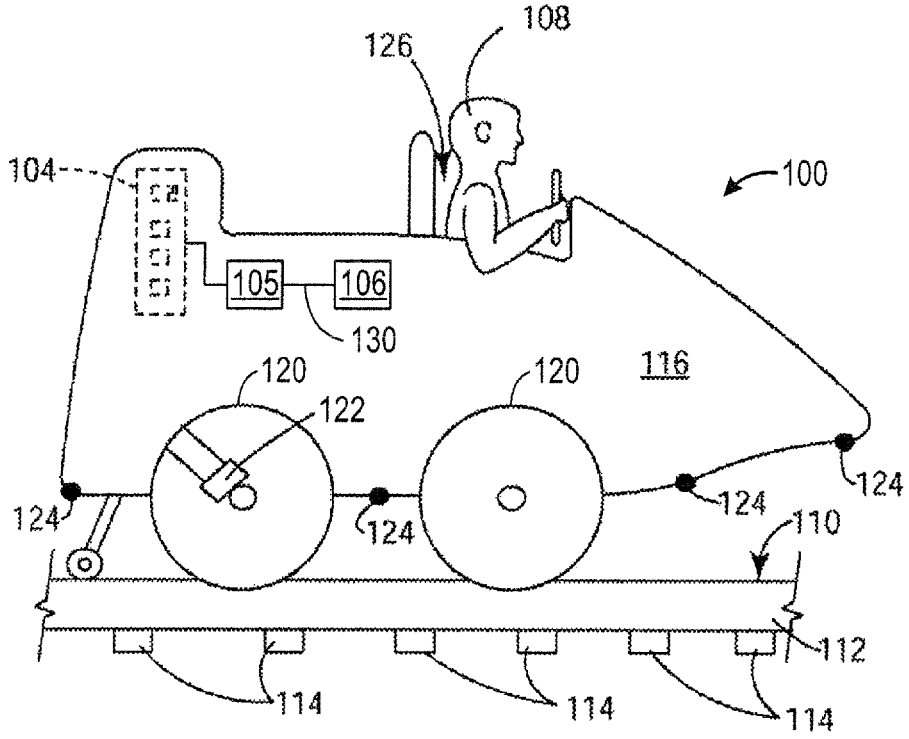
FIG. 1 is diagram showing one vehicle disposed on a portion of a path wherein the vehicle includes an onboard control system that confirms authorization for access by a operator via a wireless electronic device in accordance with one embodiment of the invention.

Referring now to FIG. 1, a vehicle, disposed on a portion of path fixed paths, is shown generally at 100. The vehicle 100 comprises a control panel 104, a body 116 and wheels 120. It will be understood that while one vehicle 100 is shown, a plurality of vehicles is contemplated, each of which may be sized to support one or more guest(s) 108 seated therein. The vehicle is disposed on a path such as a fixed path 110 supported by beams 114. A disc brake 122 is shown on wheel 120. Accordingly, as used herein, the term "vehicle" is meant to comprise vehicle that resides on a fixed path, including but not limited to any amusement park rides vehicles and devices that is capable of supporting at least one guest.

As shown, the control panel 104 may be disposed at the rear of a vehicle. However, in other embodiments, it may be advantageous to place the control panel 104 on a hood or another portion of a vehicle depending upon the position of the guest or the operator in relation to structure of the ride. While in this exemplary embodiment the vehicle is a vehicle such as in part of a rollercoaster or driving simulator, it is to be appreciated that the present invention may be applicable to rides such as log-flumes, ferris wheels, scrambler-type rides, freefall/mega-drop rides and the like.

In an embodiment of the present invention, for operator input, the control panel 104 may comprise a touch-based screen that may also be mechanically based, i.e., comprise traditional buttons and levers. The control panel, via a processor disposed therein, may incorporate wireless signals, e.g., radio-frequency identification, magnetic signature or other wireless communication for operator input. The control panel 104 provides an interface for an onboard control system 105 that through the use of a processor (not shown) may control such ride attributes as dispatch, ride speed, stopping, loading, unloading, seat tuning, safety harness tuning, operator identification, maintenance status (e.g., inspection complete) or destination request. Accordingly, the processor of the onboard control system 105 may be in circuit with speed sensors (not shown) interconnected with wheels 120, brake controllers (not shown) for brakes 122, a plurality of onboard sensors 124, fixed path controllers (not shown) and an operator identifier 106.

The sensors 124, electrically connected with the onboard control system 105 via lines 128 may be configured to sense the proper functioning of safety features such as lap-brace position or sister-vehicle proximity, e.g., a second vehicle being too close to a first vehicle. In turn, the sensors may be further configured to send a signal to the onboard control system 105 which may then, for example, signal the brake controllers to apply/lock brake 122. Furthermore, the onboard sensors may be placed in the seating cavity 126 to provide automatic seat-tuning to ensure better comfort to guest 108. Optionally, the seat-cavity sensors may send seat-tuning information to the onboard control system 105 which may display it on the control panel 104, which may then allow the operator to tune the seat to the guests liking.

The onboard system may be in further communication with off-board fixed path controllers (not shown). In this particular embodiment, the operator, via use of the onboard system, may input vehicle routing commands. The onboard system may communicate with the off-board fixed path controllers to control and switch fixed path elements, thereby providing the operator with the ability to route the vehicle to a desired destination. For example, the operator may input an "exit" command into a vehicles onboard system. The onboard system, via the onboard processor may communicate with the off-board fixed path controllers to switch the fixed path, allowing the vehicle to exit at a predetermined location.

Operator authorization and identification device (also known as "operator identifier") 106, which will be discussed in greater detail with reference to FIGS. 2, 3, and 4 may comprise automatic identification and data capture (AIDC) devices such as radio frequency identification readers, optical character recognition, voice recognition, smartcards, or biometrics. The identifier 106 may be in circuit with the onboard control system 105 via line 130. Furthermore, the operator identifier 106 may work in conjunction with a separate device, e.g. an RFID reader working in conjunction with an RFID tag that may be supported, e.g. carried by an authorized operator or incorporated within an article of clothing worn by an authorized operator.

Figure 2:
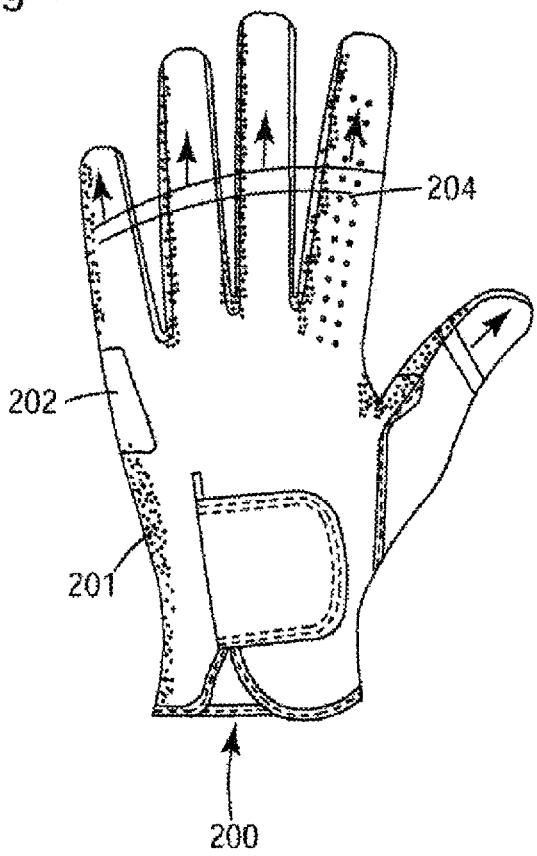
FIG. 2 is diagram showing an authorization glove including an electronic device to which embodiments of the present invention relate.

Referring now to FIG. 2, a glove comprising an electronic device configured to remotely authorize use of the onboard control system is shown generally at 200. In this exemplary embodiment, the electronic device may be a radio frequency identification transponder (hereinafter "RFID") tag 202, which may be configured to communicate with an RFID reader disposed in the ride vehicle as discussed with reference to FIG. 1. In one exemplary embodiment, the onboard control system may remain in a locked/disabled position during all times so that an unauthorized person cannot access the control panel interface. However, if an authorized operator, i.e., a park employee who is wearing the glove 201 comprising the RFID tag 202 is proximate to the RFID reader, the system may become unlocked/enabled thus allowing the authorized operator to control the system. Conversely, when the RFID reader and tag are not proximate to one another, the control system may remain in a locked/disabled position. This ensures the safety and efficacy of the system by not allowing guests or unauthorized operators to control their own or other guests ride vehicles.

The system may further provide for security layer functions within particular classes of park employees. Because each employee may have a unique identification device, only an employee that is permitted to execute a particular function will be able to execute that function. For example, maintenance employees may be the only employees permitted to update the inspection status of vehicles, and add and remove vehicles from the fixed path. The onboard system may be configured to block anyone except those maintenance employees allowed to execute these functions, thus providing an extra layer of security.

The system may further provide for the control of other park elements (e.g., show elements, guest interactive elements and quality control elements). For example, an operator may input a command to a control panel for the operation of onboard equipment such as a water cannon, communicating to the functional parameters. Also, an operator may input a command to the control panel for a picture to be taken at a certain point during the ride. The control panel may further allow for integrated quality control, e.g., by alerting an operator a vehicle is not operating to specification, needs to cleaned, maintained, etc. In this particular example, an operator may input data into the onboard system that a vehicle or a set of vehicles needs to be cleaned, and the system may guide the vehicle or set of vehicles to the appropriate venue for cleaning.

With further reference to FIG. 2, the glove, as illustrated, may be a golf or batting-type glove. For operator comfort purposes, the glove may have removable fingers such as at line 204. In further embodiments, the electronic authorization device may be implanted or attached to a wristband or cuff. Alternatively, the device maybe included in the operator's uniform. The authorization device may also include a magnetic wand. Furthermore, the RFID may be active, passive or semi-passive depending upon the ride environment. For instance, it may be more reliable to employ the use of an active RFID in steel rollercoasters or log flumes due to conductance concerns, while passive RFIDs may be suitable for wooden rollercoaster and smaller rides.

Figure 3:
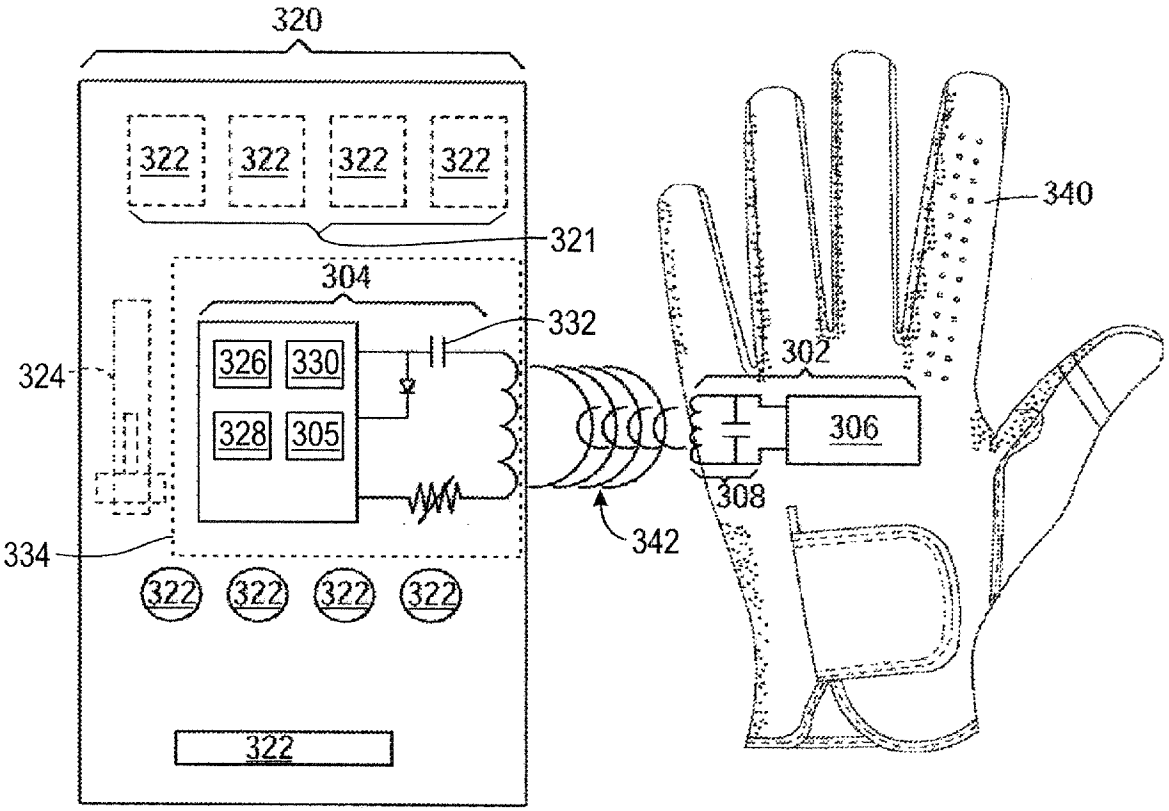
FIG. 3 is a schematic diagram of the electronic device of FIG. 2.

Now referring to FIG. 3, an exemplary embodiment of an onboard control panel 320 comprising an operator identification and authorization device 304 disposed behind the control panel under shield 334. Also shown is an electronic device, here an RFID tag 302, configured to communicate with the operator identification and authorization device 304 via wireless communication (e.g., radio frequency waves 342).

In this exemplary embodiment, the panel may comprise a keypad 321 with keys 322, and a mechanical lever 324. Disposed in or under the casing of the panel there may be an RFID reader, which may act as the operator identification and authorization device 304. The reader may comprise an energizer 326, demodulator 328, and decoder circuitry 330. The tuned antenna capacitor circuit 332 may emit a low frequency radio-wave field and may be used to power up the tag 302. As is known in the art, the reader may use the demodulator 328 to demodulate the signal sent by the tag 302. The information may then be decoded via an onboard microcontroller 305 and sent to the processor (not shown) of an onboard control system such as the on board control system 105 of FIG. 1. The processor may then match the data with prestored operator tag data and, if found, authorize that particular operator supporting the tag 302 to operate the ride vehicle control panel 320.

The electronic device configured to communicate with the operator identification and authorization device is shown as an RFID tag 302 attached to a glove 340, which may be worn by an operator. The tag 302 may include a transponder 306 and antenna coil 308. When in proximity to the reader, the tag may become powered up and transmit data wirelessly via radio frequency waves 342. After successful transmission, authorization of the operator may occur via the processor of the vehicle control system, and again if applicable, allowing an operator use of the control panel 320.

While any of low, mid or ultra-high frequency RFIDs may be used, low frequency e.g., 125/134 KHz, may be most advantageous in an amusement park setting because only operators in the closest proximity to the ride vehicle become authorized. Furthermore, the each operator may have his or her own RFID tag so that the processor, via preloaded data, may recognize which authorized operator is controlling the ride at a particular time. This may provide a further advantage in that theme park management may then be capable of monitoring which operators are operating each ride at which time.

Figure 4:
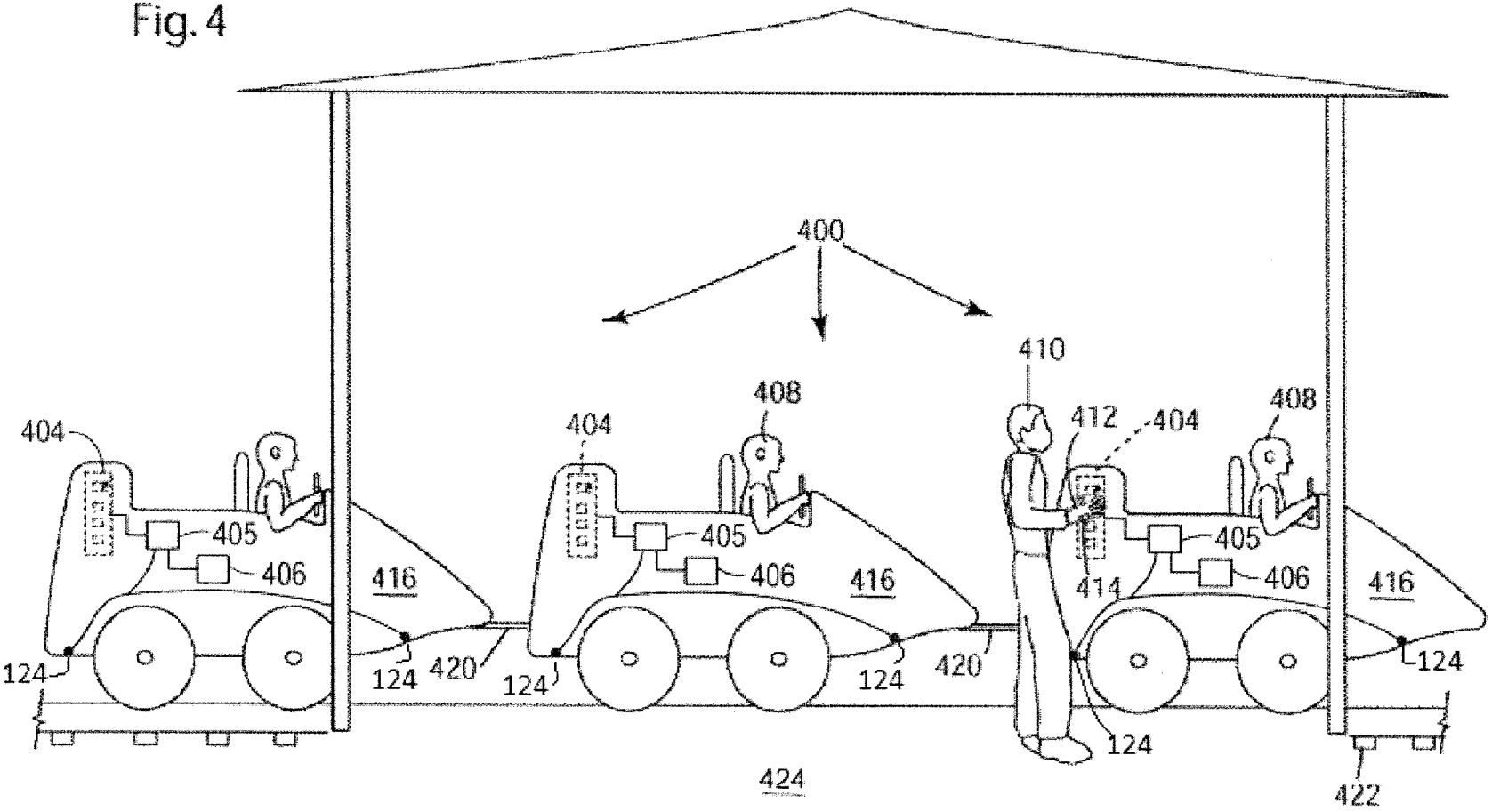
FIG. 4 is a diagram showing a plurality of ride vehicles disposed on a portion of a path and an operator wearing the authorization glove of FIG. 2.

Now with reference to FIG. 4, a diagram showing a plurality of ride vehicles disposed on a portion of a path and an operator wearing the authorization glove of FIG. 2 is shown generally at 400. The ride shown generally is a roller-coaster type ride with a plurality of ride vehicles 416 connected at each connection bar 420 and disposed on fixed path 422. Each ride vehicle 416 may comprise an onboard control panel 404 in circuit with onboard control system 405, which may be further in circuit with an operator identification and authorization device 406 and sensors 124. However, in alternative embodiments where the lead vehicle is attached and capable of controlling subsequent vehicles, the lead ride vehicle may be the sole ride vehicle comprising the onboard panel 404, system 405 and authorization device 406.

With further reference to FIG. 4, the operator 410 may be wearing authorization glove 412, which may have an attached electronic device configured to communicate with the authorization device 406. The onboard system 405 may then compare preloaded data with the data received from the authorization glove and, if appropriate, allow the operator 410 to access and operate the onboard panel 404. The operator may then control such ride aspects as dispatch, ride speed, stopping, loading, unloading, seat tuning, safety harness tuning, vehicle maintenance, and show elements.

The combination of the electronic authorization device 406, e.g., the reader of an RFID disposed in a ride vehicle, and a device configured to communicate with the authorization device, e.g., an RFID tag 414 attached to an operator's glove 412, belt, ring or other local garment, or a wand may allow the operator to be freely movable around the ride platform 424. This aspect of the present invention allows for increased interaction with guests, increased efficiency, and obviates the need for an off-board console that typically requires an operator to be positioned in one place at all times. Furthermore, the mobility aspect of the invention allows one operator to perform safety procedures and control ride features, obviating the need for a second operator on the ride platform if desirable.

In another embodiment, the invention provides a method for controlling an amusement park ride comprising confirming operator authorization via an onboard vehicle control system wherein if an electronic device configured to communicate with vehicle system is proximate thereto, the operator is authorized to control the system.

In this particular embodiment controlling an amusement park ride occurs at the onboard control system disposed in at least one of the ride vehicles. The onboard control system may be configured to control dispatch, ride speed, stopping, loading, unloading, seat tuning, safety harness tuning, and vehicle maintenance via a processor, in circuit with onboard sensor, an operator authorization and identification device, and an onboard control panel. The control panel may comprise a touch screen, mechanically based buttons and levers or a combination thereof.

To ensure the safety and efficacy of the present invention, the method may provide for electronic authorization of the ride operator. This protective step helps to ensure that guests are unable to operate the control panel themselves, as they may be in vicinity of it. For example, electronic authorization may comprise the use of an RFID tag being attached to the clothing of the ride operator. The ride operator also may wear a glove that has an RFID tag attached to it. When the RFID tag is proximate to the RFID reader which may be disposed in the ride vehicle, the system may then become enabled for use, allowing only the operator wearing the proper tag to use the control panel.

The method may further provide for security layer functions within particular classes of park employees. Because each employee may have a unique identification device, only an employee that is permitted to execute a particular function will be able to execute that function. For example, maintenance employees may be the only employees permitted to update the inspection status of vehicles, and add and remove vehicles from the fixed path. The onboard system may be configured to block anyone except those maintenance employees allowed to execute these functions, thus providing an extra layer of security.

The method may further provide for the control of other park elements (e.g., show elements, guest interactive elements and quality control elements). For example, an operator may input a command to a control panel for the operation of water cannon, where it may squirt a performer in a comedy show at a particular point in the show. Also, an operator may input a command to the control panel for a picture to be taken at a certain point during the ride. The control panel may further allow for integrated quality control, e.g., by alerting an operator a vehicle is not operating to specification, needs to cleaned, maintained, etc.

Although specific features of various embodiments of the invention may be shown in some drawings and not in others, this is for convenience only. In accordance with the principles of the invention, the feature(s) of one drawing may be combined with any or all of the features in any of the other drawings. The words "including", "comprising", "having", and "with" as used herein are to be interpreted broadly and comprehensively and are not limited to any physical interconnection. Moreover, any embodiments disclosed herein are not to be interpreted as the only possible embodiments. Rather, modifications and other embodiments are intended to be included within the scope of the appended claims.

What is claimed is:

1. A system comprising:

a least one vehicle, comprising:

an onboard control system configured to control attributes of the vehicle, wherein the onboard control subsystem compromises an onboard control panel disposed on the vehicle an operator authorization and identification device configured to receive an authentication signal, determine whether the authentication signal corresponds to authorized access, and control access to configuration of the onboard control system based on whether the authentication signal is determined to correspond to authorized access; and an electronic device dimensioned and configured to be supported by an operator, the electronic device being farther configured to remotely provide the authentication signal to the operator authorization and identification device.

2. The system of claim 1, wherein the onboard control system is configured to control the attributes of the vehicle including at least one of dispatching of the vehicle, slowing of the vehicle, stopping of the vehicle, loading of the vehicle, unloading of the vehicle, tuning seats of the vehicle, tuning a safety harness of the vehicle, and enabling access to maintenance of the vehicle.

3. The system of claim 1, wherein the onboard control panel is recessed in the vehicle.

4. The system of claim 1, wherein the onboard control system comprises the operator authorization and identification device, which comprises an RFID reader.

5. The system of claim 4, wherein the RFID reader is configured to operate at a low frequency.

6. The system of claim 1, wherein the electronic device comprises a radio frequency identification tag.

7. The system of claim 1, wherein the electronic device is attached to a wand configured to be attached to an operator.

8. The system of claim 1, wherein the electronic device is attached to an article configured to be worn by the operator.

9. The system of claim 1, wherein the onboard control system is configured to block access to configuration of the onboard control system unless the electronic device is proximate thereto.

10. The system of claim 1, wherein the onboard control system is configured to facilitate access to configuration of the onboard control system when the electronic device is proximate thereto and the authentication signal is determined to correspond to authorized access.

11. The system of claim 1, further comprising sensors attached to the vehicle to sense the proper functioning of safety features and configured to communicate with the onboard control system to control attributes of the vehicle.

12. The system of claim 1, further comprising an off-board control system in communication with the onboard control system of the vehicle, wherein the onboard control system is further configured to store operator input and communicate the input to the off-board control system.

13. The system of claim 1, comprising a steel rollercoaster or log flume, wherein the vehicle is a component of the steel rollercoaster or log flume, and the onboard control unit comprises an active-mode RFID reader.

14. The system of claim 1, comprising a lead vehicle and one or more subsequent vehicles, wherein the lead vehicle is the only vehicle comprising the onboard control system, and the onboard control system is configured to control the lead vehicle and the one or more subsequent vehicles.

15. A method comprising: preventing unauthorized access to configuration of an onboard control system of a vehicle; receiving, via an operator authorization and identification device, an authorization signal sent from an electronic device worn by an operator authorized to access the onboard control system;

determining an operator identity or class of the operator based upon the authorization signal;

confirming operator authorization via the onboard vehicle control system based upon the operator identity or class; and providing identity-specific or class-specific configuration access to the onboard control system based upon the confirmed authorization wherein the identity-specific configuration access is provided to the onboard control system via an onboard control panel.

16. The method of claim 15, comprising controlling at least one of dispatch, slowing, stopping, loading, unloading, seat tuning and safety harness tuning, vehicle maintenance, show functions, and quality control via the onboard control system.

17. The method of claim 15, wherein receiving an authorization signal comprises receiving an authorization signal from a radio frequency identification tag.

18. The method of claim 15, wherein the onboard control system comprises the operator authorization and identification device, which comprises an RFID reader.

19. The method of claim 15, further comprising:

sensing whether the safety features are functioning properly via sensors attached to the vehicle;

sending a signal from the sensors to the onboard control system; and controlling attributes of the vehicle via the onboard control system based on the signal from the sensors.

20. The method of claim 15, further comprising storing an operator input via the onboard control system and communicating the input to an off-board control system via the onboard control system.

21. The method of claim 15, comprising:

providing a maintenance class with access to the onboard control system to update an inspection status of the vehicle and/or direct vehicles from the fixed path; and providing an operator class with access to the onboard control system to control ride attributes.

22. A system comprising:

at least one vehicle, comprising:

an onboard control system configured to control attributes of the vehicle;

an operator authorization and identification device configured to receive m:~ authentication signal, determine whether the authentication signal corresponds to authorized access, and control access to configuration of the onboard control system based on whether the authentication signal is determined to correspond to authorized access; and an electronic device dimensioned and configured to be supported by an operator, the electronic device being further configured to remotely provide the authentication signal to the operator authorization and identification device: and sensors attached to the vehicle to sense the proper functioning of the safety features and configured to communicate with the onboard control system to control attributes of the vehicle.

23. The system of claim 22, wherein the electronic device is attached to a wand configured to be attached to an operator.

24. The system of claim 22, wherein the electronic device is attached to an article configured to be worn by the operator.

25. The system of claim 22, further comprising an off-board control system in communication with the onboard control system of the vehicle, wherein the onboard control system is fresher configured to store operator input and communicate the input to the off-board control system.

* * * * *